US007046945B2

(12) United States Patent
Nishitani et al.

(10) Patent No.: US 7,046,945 B2
(45) Date of Patent: May 16, 2006

(54) DEVELOPING APPARATUS

(75) Inventors: Hitoshi Nishitani, Ibaraki (JP); Keiko Fujita, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/682,870

(22) Filed: Oct. 14, 2003

(65) Prior Publication Data

US 2004/0076452 A1 Apr. 22, 2004

(30) Foreign Application Priority Data

Oct. 15, 2002 (JP) ..... 2002-299940

(51) Int. Cl.
*G03G 15/08* (2006.01)

(52) U.S. Cl. ..... 399/254

(58) Field of Classification Search ..... 399/254–256, 399/258

See application file for complete search history.

(56) References Cited

U.S. PATENT DOCUMENTS

| | | | | |
|---|---|---|---|---|
| 4,496,644 | A | 1/1985 | Ateya et al. | 430/122 |
| 5,682,583 | A | 10/1997 | Ito et al. | 399/254 |
| 5,842,090 | A | 11/1998 | Mikawa | 399/256 |
| 6,415,125 | B1 * | 7/2002 | Yamamoto et al. | 399/254 |
| 6,597,882 | B1 * | 7/2003 | Tanaka | 399/258 |

FOREIGN PATENT DOCUMENTS

| | | |
|---|---|---|
| JP | 55-32060 | 3/1980 |
| JP | 59-165082 | 9/1984 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A developing apparatus includes a developing container including a first chamber having a developer carrying member for carrying developer and a second chamber disposed in an inclined manner to which toner is supplied. First and second communicating portions supply developer between longitudinal end sides of the first and second chambers. A ceiling portion of one end side of the second chamber is disposed lower than a ceiling portion of one end side of the first chamber. A developer supplying screw supplies the toner to the second chamber through a supply port provided in a bottom of a developer supplying path. The supply port is disposed in a position lower than the ceiling portion and is located at an upper portion on a downstream side of the first communicating portion in a developer conveying direction on one end side of the chamber.

5 Claims, 9 Drawing Sheets

101
103
104
107
108
1
3
4
5a
7
8
D
D'
V

DEVELOPING APPARATUS

BACKGROUND OF THE INVENTION

1. Field of the Invention

This invention relates to a developing apparatus for use in a copying machine, a printer, a facsimile apparatus or the like adopting an electrophotographic process or an electrostatic recording process.

2. Description of Related Art

In an image forming apparatus of this kind, there is well known a method of carrying a dry developer as a visualizing agent on the surface of a developer carrying member, conveying and supplying the developer to the vicinity of the surface of an image bearing member bearing an electrostatic latent image thereon, and developing and visualizing the electrostatic latent image while applying an alternating electric field to between the image bearing member and the developer carrying member. Generally a developing sleeve is often used as the developer carrying member and therefore, the developer carrying member will hereinafter be referred to as the "developing sleeve", and generally a photosensitive drum is often used as the image bearing member and therefore, the image bearing member will hereinafter be referred to as the "photosensitive drum".

As a developing method, there is known a so-called magnetic brush developing method of using, for example, a developer (two-component developer) comprising a two-component composition (carrier particles and toner particles), forming a magnetic brush on the surface of the developing sleeve having a magnet disposed therein, rubbing or bringing this magnetic brush against or close to the photosensitive drum opposed to the developing sleeve with a minute developing gap held therebetween, and continuously applying an alternating electric field to between the developing sleeve and the photosensitive drum (between S-D) to thereby respectively effect the shift and reverse shift of the toner particles from the developing sleeve side to the photosensitive drum side, thereby effecting development (see, for example, Document 1 (Japanese Patent Application Laid-Open No. S55-32060) and Document 2 (Japanese Patent Application Laid-Open No. S59-165082).

A developing apparatus for the above-described two-component magnetic brush developing is of a construction as shown in FIGS. 7 and 8 of the accompanying drawings. FIG. 7 is a cross-sectional view of a conventional developing apparatus, and FIG. 8 is a plan view thereof, and in FIGS. 7 and 8, the reference numeral 101 designates a developing sleeve, the reference numeral 102 denotes a magnet roller fixedly disposed in the developing sleeve 101, the reference numeral 103 designates a developing chamber screw, the reference numeral 104 denotes an agitating chamber screw, the reference numeral 105 designates a developing container, the reference character 105*a* denotes a toner supply port, the reference character 105*b* designates a developing chamber, the reference character 105*c* denotes an agitating chamber, the reference numeral 106 designates a regulating blade disposed to form a thin layer of developer on the surface of the developing sleeve 101, the reference numeral 107 denotes a toner storing container for storing a toner therein, and the reference numeral 108 designates a supplying screw for supplying the toner from the toner storing container 107 to the developing apparatus. As shown, the developing sleeve 101 is disposed in proximity to a photosensitive drum 109, and is rotated in an opposite direction to or the same direction as the direction of rotation of the photosensitive drum 109, and is set so that a developer (indicated by hatching) can develop in contact with the photosensitive drum 109.

A developer consisting of toner particles and a magnetic carrier mixed together is contained in the developing container 105, and the mixing ratio (hereinafter referred to as the T/C ratio) of the toner particles and the magnetic carrier is such that an amount of toner corresponding to the toner consumed by developing is supplied from the toner storing container 107 in which the toner to be supplied is contained by the supplying screw 108. The supplied developer drops and is supplied into the agitating chamber in which the agitating chamber screw 104 is provided, via the supply port 105*a* of the developing container 105, whereby the T/C ratio is kept constant. As methods of detecting and maintaining the mixing ratio of the toner particles and the magnetic carrier in the developing container 105 at this time, there have heretofore been proposed various methods.

For example, a method of providing detecting means around the photosensitive drum, applying light to the toner transferred from the developing sleeve side to the photosensitive drum side, adjusting the toner supply amount from transmitted light and reflected light at this time and maintaining the T/C ratio, a method of providing detecting means on the developing sleeve, and detecting the T/C ratio from reflected light when light is applied to the developer applied onto the developing sleeve, a method of providing a sensor in the developing container, and detecting any change in the apparent permeability $\mu$ of the developer in a constant volume near the sensor by the utilization of the inductance of a coil to thereby detect the T/C ratio (hereinafter referred to as the toner density detecting sensor), etc. have been proposed and put into practical use.

The toner density detecting sensor utilizing the change in the permeability of the developer is such that for example, when the permeability has become great, it means that the T/C ratio in the developer in a constant volume has become low, and this means that the amount of toner in the developer has decreased and therefore, toner supply is started. Conversely, when the permeability has become small, it means that the T/C ratio in the developer in the constant volume has become high, and this means that the amount of toner in the developer has increased and therefore, the T/C ratio is controlled on the basis of such a sequence as stops toner supply.

On the other hand, as shown in FIG. 8, the developing sleeve 102, the developing chamber screw 103 and the agitating chamber screw 104 are rotatively driven in predetermined directions at a predetermined speed by a drive source such as a motor not shown, via drive transmitting means such as a gear train, whereby the developer in the developing container 105 is circulated in the direction indicated by the arrow indicated in FIG. 8. Indicated by a grid line is the position of the toner supply port 105*a*. A fresh toner supplied through this supply port 105*a* is uniformly agitated with the developer while it is carried over the length A of the agitating chamber, and is sufficiently subjected to triboelectrification and is circulated to the developing chamber. In the developing chamber, the magnetic brush of the developer is formed by a developing magnetic field formed by the magnet roller which is also the shaft of the developing sleeve, and the toner adhering to the magnetic brush and the toner adhering to the surface of the developing sleeve 102 shift to the image area of an electrostatic latent image formed on the photosensitive drum 109 and developing is effected.

In recent years, however, with the spread of copying machines, printers, facsimile apparatuses, etc. using the electrophotographic process, the electrostatic recording process or the like, the demand from the market for the downsizing of those apparatuses and the larger capacity of the toner storing container for a reduction in running cost is very strong. FIGS. 9A and 9B of the accompanying drawings are views for illustrating a factor which determines the height of an image forming apparatus using the aforedescribed two-component developing apparatus, and FIG. 9A is a schematic cross-sectional view, and FIG. 9B is a schematic rear view taken along the direction indicated by the arrow V in FIG. 9A. Here, the height H1 of the developing apparatus in the image forming apparatus is determined by another element in the developing apparatus which is not shown, and it is assumed that the position H1 shown in FIG. 9A is the lowest position at which the developing apparatus can be disposed.

As already described, with the lowering of the T/C ratio in the developing apparatus, the toner is supplied from the toner storing container 107 through the supply port 105*a* via the supplying screw 108. Generally, a supply port and a shutter mechanism are provided at a position higher than the height of the surface of powder in the supply port. This is because the developing container is an interchangeable unit and therefore, if the supply port and the shutter are at a position higher than the surface of powder, it is difficult for the developer to scatter during the mounting and dismounting thereof.

Also, as regards the carrying of the toner, it is desirable to carry the toner from above to below or horizontally without opposing gravity as far as possible, and in order also to avoid such an inconvenience as the remaining or clogging of the toner in a toner carrying path, it is preferable to avoid the carrying of the toner from below to above. Accordingly, to avoid such inconveniences as the scattering of the developer and the remaining or clogging of the toner in the toner carrying path, it is desirable to provide the supply port at a position higher than the surface of powder in the developing container, and dispose the toner storing container and the supplying screw at the same position as or a position higher than that.

Here, from the viewpoint of the downsizing of the apparatus, the dimension to the uppermost surface (H2 in FIG. 9A) should be made as small as possible, and from the viewpoint of making the toner storing container large in capacity to reduce the running cost, the space higher than the surface of powder in the developing container (H2 dimension in FIG. 9A) should be made as large as possible and therefore, it will be seen that "the downsizing of the apparatus" and "the larger capacity of the toner storing container" are mutually contradictory requirements.

That is, if the conventional construction remains unchanged, to satisfy one of "the downsizing of the apparatus" and "the larger capacity of the toner storing container", the other will be sacrificed, and to satisfy both, the supply port will be provided at a position lower than a powder surface or the toner storing container will be disposed at a position lower than the developing apparatus to thereby effect the carrying of the toner opposing gravity, and cause such inconveniences as the scattering of the developer and the remaining or clogging of the toner in the toner carrying path, thus spoiling the reliability as the developing apparatus. This has been the great problem that in the image forming apparatus, the downsizing of the apparatus and the larger capacity of the toner storing container and the maintenance of reliability cannot be satisfied at a time.

SUMMARY OF THE INVENTION

It is an object of the present invention to provide a developing apparatus of which the downsizing can be achieved.

It is another object of the present invention to provide a developing apparatus which can make both of the downsizing of the apparatus and the larger capacity of a container for supplying a toner to a developing container compatible.

It is another object of the present invention to provide a developing apparatus for developing an electrostatic image formed on an image bearing member, the developing apparatus having:

a developing container containing a developer including toner and carrier;

a partition portion for partitioning the developing container into a first chamber for developing the electrostatic image on the image bearing member and a second chamber for receiving the supply of the toner;

circulating means for circulating the developer between the first chamber and the second chamber, wherein the second chamber is provided so that a side thereof for receiving the developer from the first chamber may be located below the first chamber, and may be upwardly inclined toward a side for delivering the developer to the first chamber; and a toner supplying path for supplying the toner to an area of the second chamber which is located below the first chamber, wherein the toner supplying path is provided so that at least a portion thereof may be opposed to the first chamber with the partition portion interposed therebetween.

It is another object of the present invention to provide a developing apparatus for developing an electrostatic image formed on an image bearing member, the developing apparatus having:

a developing container containing a developer including toner and carrier;

a partition portion for partitioning the developing container into a developing chamber and an agitating chamber constituting a circulation path for the developer; and circulating means for circulating the developer between the developing chamber and the agitating chamber, wherein the agitating chamber is provided while being inclined with respect to the developing chamber so that an area thereof for receiving the developer from the developing chamber may be located below the developing chamber, and an area thereof for delivering the developer to the developing chamber may be located above the developing chamber.

Further objects of the present invention will become apparent from the following detailed description when read with reference to the accompanying drawings.

DETAILED DESCRIPTION OF THE PREFERRED EMBODIMENTS

Some embodiments of the present invention will hereinafter be described with reference to the accompanying drawings.

First Embodiment

Figure 1:
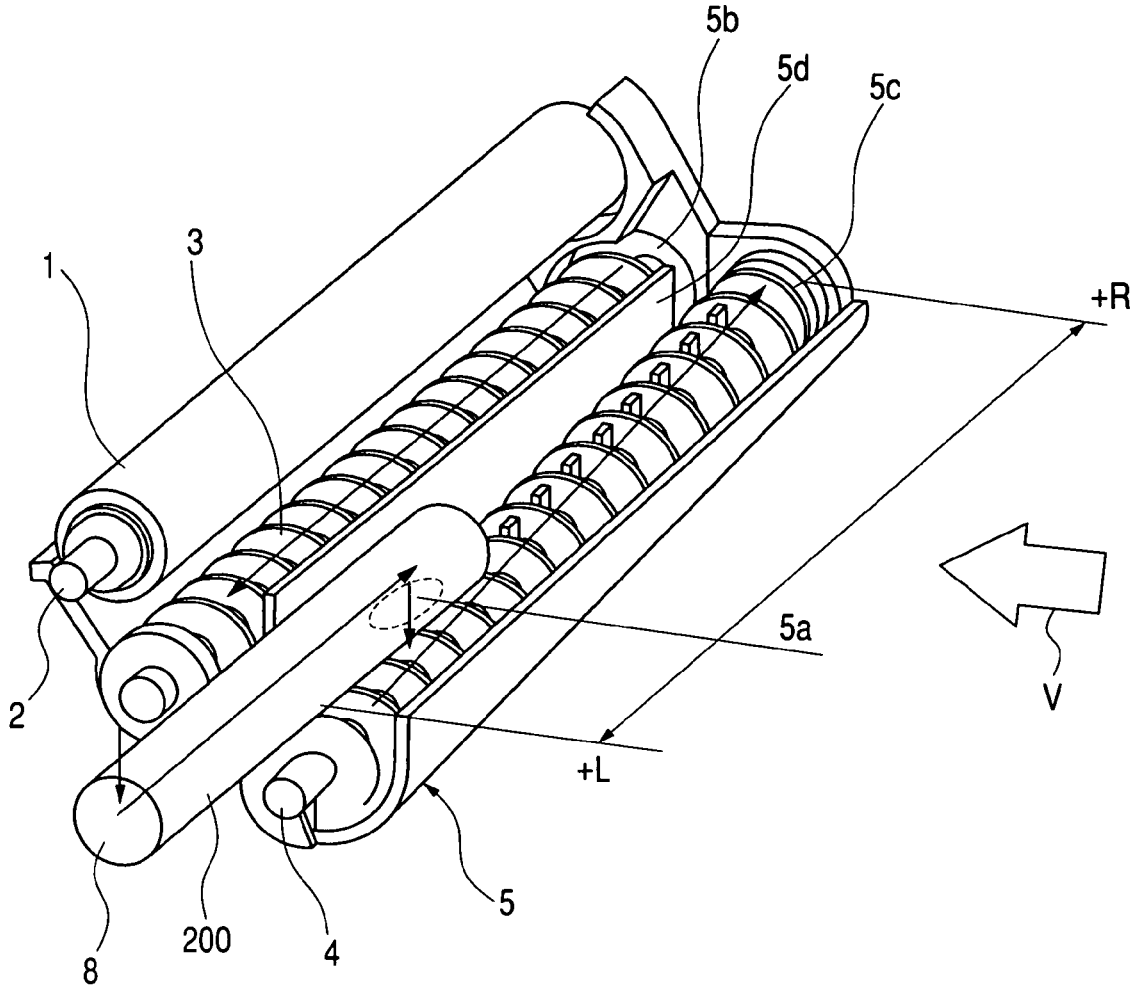
FIG. 1 is a perspective view of a developing apparatus according to a first embodiment of the present invention.

FIG. 1 is a perspective view of a developing apparatus according to a first embodiment of the present invention. In this developing apparatus, the reference numeral 1 designates a developing sleeve (developer supplying member), the reference numeral 2 denotes a magnet roller, the reference numeral 3 designates a developing chamber screw (first agitating and carrying means), the reference numeral 4 denotes an agitating chamber screw (second agitating and carrying means), and the reference numeral 5 designates a developing container. The upper half of the developing container 5 is omitted to make the interior thereof readily seen, and a supply port is formed at a position indicated by dotted line 5*a*. The interior of the developing container 5 is comparted into a developing chamber (first chamber) 5*b* and an agitating chamber (second chamber) 5*c* which together constitute a circulation path for a developer, and the reference character 5*d* denotes the partition wall thereof.

An amount of toner corresponding to the toner consumed by developing falls and is supplied into the agitating chamber 5*c* through the supply port 5*a* (located in an image forming area in the lengthwise direction of the developing container) of a toner supplying tube (toner supplying path) 200 located in the upper portion of the agitating chamber 5*c*, by the action of a supplying screw 8 provided in the toner supplying tube 200. This toner supplying tube, as shown in FIG. 1, is introduced and installed from that side of the agitating chamber which is lower in position into the upper portion of the supplying position of the agitating chamber on the upstream side with respect to a developer carrying direction so as to be substantially parallel to the developing chamber (the developing chamber screw and the developing sleeve).

In the agitating chamber, the agitation and triboelectrification of the toner and the developer after supplied are effected by the action of the agitating chamber screw, and the developer is circulated in the developing container by the action of the developing chamber screw, and an electrostatic latent image on a photosensitive drum is developed by the magnetic brush of the developer formed on the developing sleeve by the magnet roller, as in the example of the conventional art. In FIG. 1, the arrow indicates the direction of circulation of the developer.

Here, a feature of the developing apparatus of the present invention is that as shown, the axial direction of the agitating chamber screw 4 is inclined with respect to the axial directions of the developing sleeve 1 and the developing chamber screw 3, and the direction of the inclination is a direction in which the carrying direction of the developer in the agitating chamber screw 4 becomes a rising direction.

That is, (the bottom of) the agitating chamber is provided such that a side thereof for receiving the developer from the developing chamber is located below (the bottom of) the developing chamber and is upwardly inclined toward a side for delivering the developer to the developing chamber. As shown in FIG. 1, the toner supplying tube is designed to drop and supply the toner to that area of the agitating chamber which is located below the developing chamber. This toner supplying tube is provided so that at least a portion thereof may be opposed to the developing chamber with a partition wall interposed therebetween.

The developing chamber screw and the agitating chamber screw are provided along the bottoms of the developing chamber and the agitating chamber, respectively, and are designed to be capable of well agitating and carrying the developer in the developing chamber and the agitating chamber.

By adopting such a construction and arrangement, the compactness of the developing apparatus in a vertical direction (the direction of gravity) is contrived.

Figure 2A:
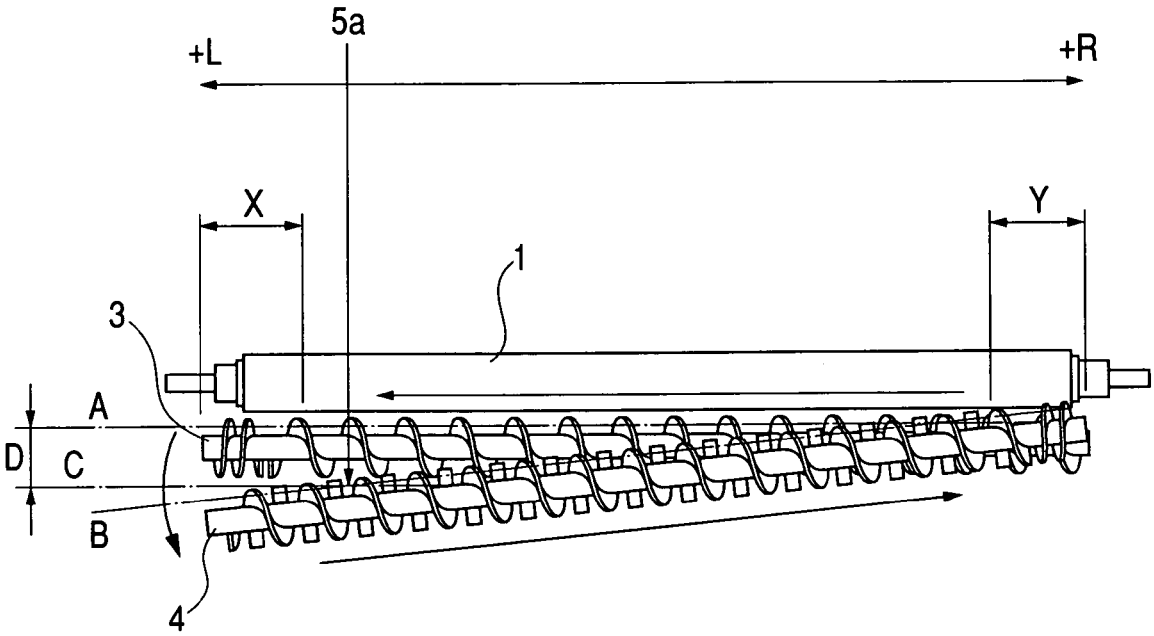
FIG. 2A is a view of the developing apparatus according to the first embodiment as viewed along the direction indicated by the arrow V in FIG. 1.

FIG. 2A is a view of the developing apparatus according to the first embodiment of the present invention as it is seen along the direction indicated by the arrow V, and assuming that the developing chamber screw 3 is horizontal, it will be seen that when the agitating chamber screw 4 is rotated, the agitating chamber screw 4 is inclined in an upward direction in which the developer is carried. Also, in FIG. 2A, the letter A represents the height of the powder surface of the developer in the developing chamber 5*b*, and the letter B represents the height of the powder surface of the developer in the agitating chamber 5*c*. In the conventional developing apparatus wherein the developing chamber screw and the agitating chamber screw are parallel to each other, both of the height of the powder surface of the developer in the developing chamber and the height of the powder surface of the developer in the agitating chamber are A in FIG. 2A, and the supply port is provided at a position higher than A in FIG. 2A.

In the developing apparatus according to the present embodiment, however, the agitating chamber screw 4 is inclined and therefore, the height of the powder surface of the developer in the agitating chamber 5*c* is low as indicated by B in FIG. 2A and thus, assuming that the supply port 5*a* is provided at a position 5*a* between +L to +R in the lengthwise direction of the screw, the supply port 5*a* can be provided at a height C in FIG. 2A, and when the developing apparatus is regarded as the reference, it becomes possible to provide the supply port at a position lower by a dimension D in FIG. 2A, as compared with the example of the conventional art.

Figure 2B:
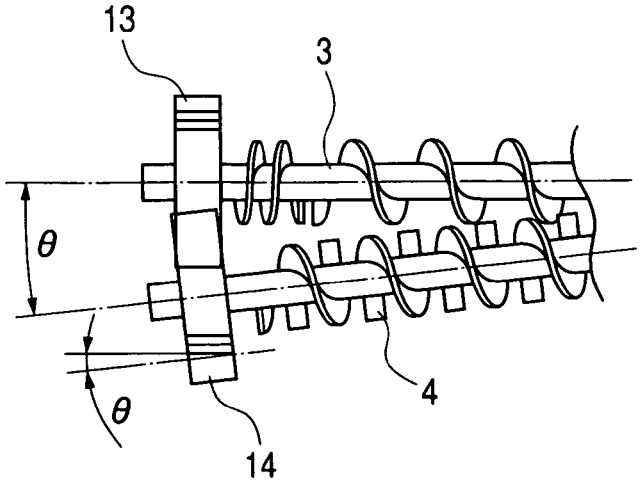
FIG. 2B shows an example of the gear construction of a developing chamber screw and an agitating chamber screw.

FIG. 2B shows an example of a gear construction to which the rotative driving of the developing chamber screw 3 and the agitating chamber screw 4 is inputted, and in FIG. 2B, the reference numeral 13 designates a gear (first gear) fixed coaxially with the developing chamber screw 3, the reference numeral 14 denotes a gear (second gear) fixed coaxially with the agitating chamber screw 4, and the gear 13 is a spur gear and the gear 14 is a helical gear.

In a case where as in the example of the conventional art, the developing chamber screw and the agitating chamber screw are parallel to each other, it is easy to provide gears on the end portions of the respective screws to thereby transmit drive, but in the case of the present embodiment, the screws are twisted to each other and therefore, the drive cannot be transmitted by a spur gear alone. However, by adopting a helical gear or a bevel gear or the like as one of the gears as shown in FIG. 2B, it is possible to directly bring the gears into meshing engagement. Therefore, again in the developing apparatus according to the present embodiment, as in the example of the conventional art, a simple driving construction is possible.

While in FIG. 2B, there has been shown an example in which the gear 13 is a spur gear and the gear 14 is a helical gear and the inclination of the rotary central shaft is changed, there will be no problem even if the gear 14 is a spur gear and the gear 13 is a helical gear. It is also possible to interpose another gear between the two gears to thereby construct a gear train, and provide a helical gear in the gear train to thereby change the inclination of the rotary central shaft. Of course, it is also possible to use a bevel gear to change the twist of the driving shaft.

Figures 3A, 3B, 3C:
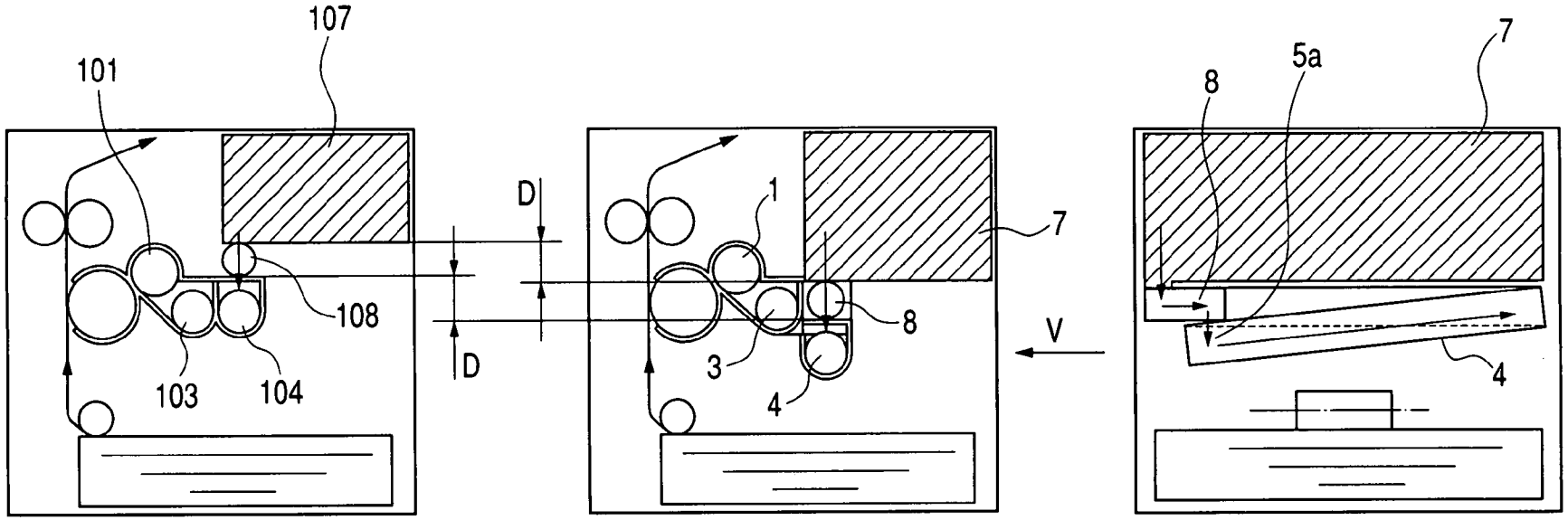
FIG. 3A shows an example in which a conventional developing apparatus is applied to an image forming apparatus.
FIG. 3B shows an example in which the developing apparatus of the present invention is applied to an image forming apparatus.
FIG. 3C is a view as viewed along the direction indicated by the arrow V in FIG. 3B.
Figure 4C:
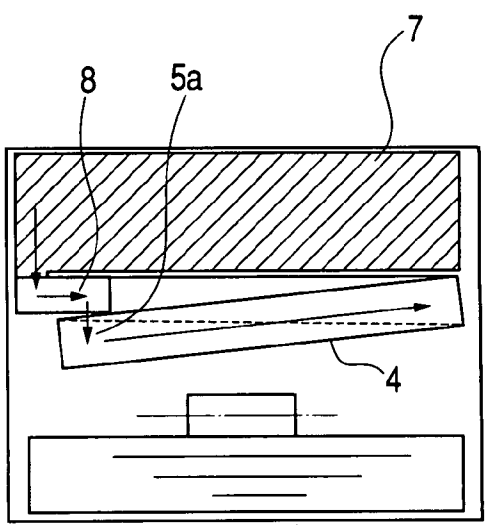
FIG. 4C is a view as viewed along the direction indicated by the arrow V in FIG. 4B.
Figure 4B:
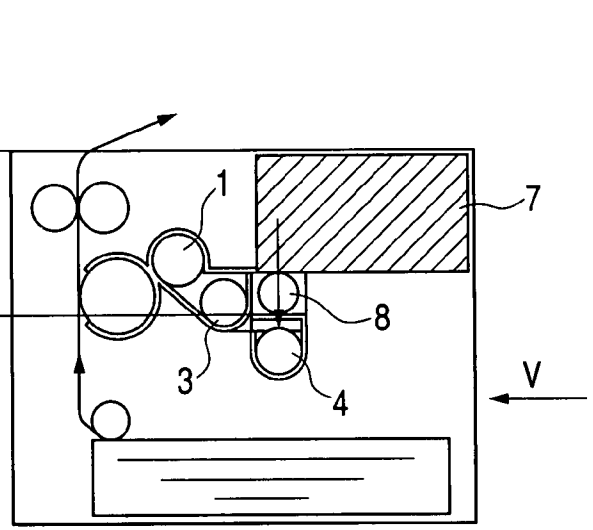
FIG. 4B shows an example in which the developing apparatus of the present invention is applied to an image forming apparatus.
Figure 4A:
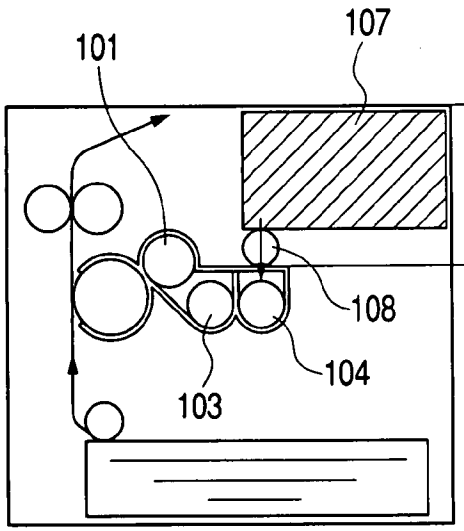
FIG. 4A shows an example in which a conventional developing apparatus is applied to an image forming apparatus.
Figure 9B:
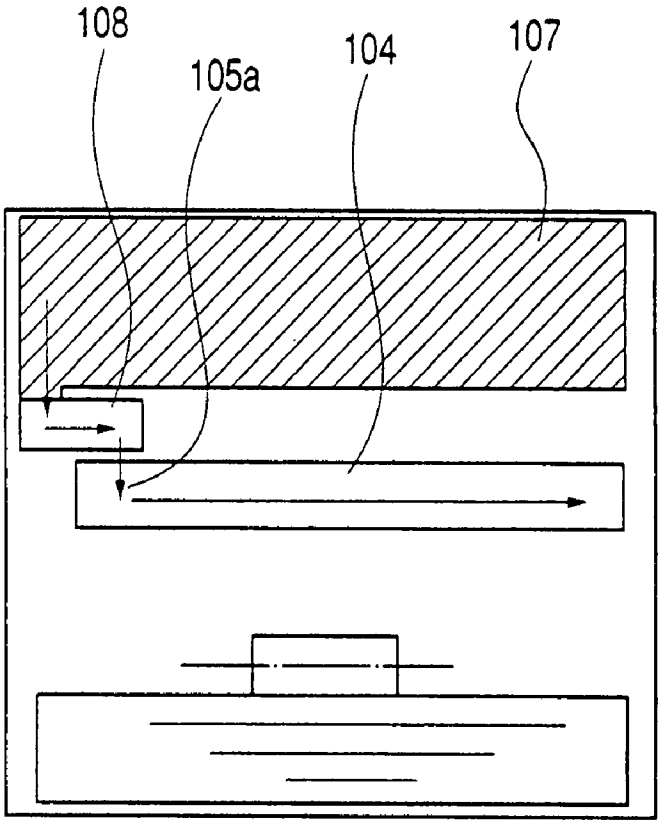
FIG. 9B PRIOR ART
FIG. 9B is a schematic rear view as viewed along the direction indicated by the arrow V in FIG. 9A.
Figure 9A:
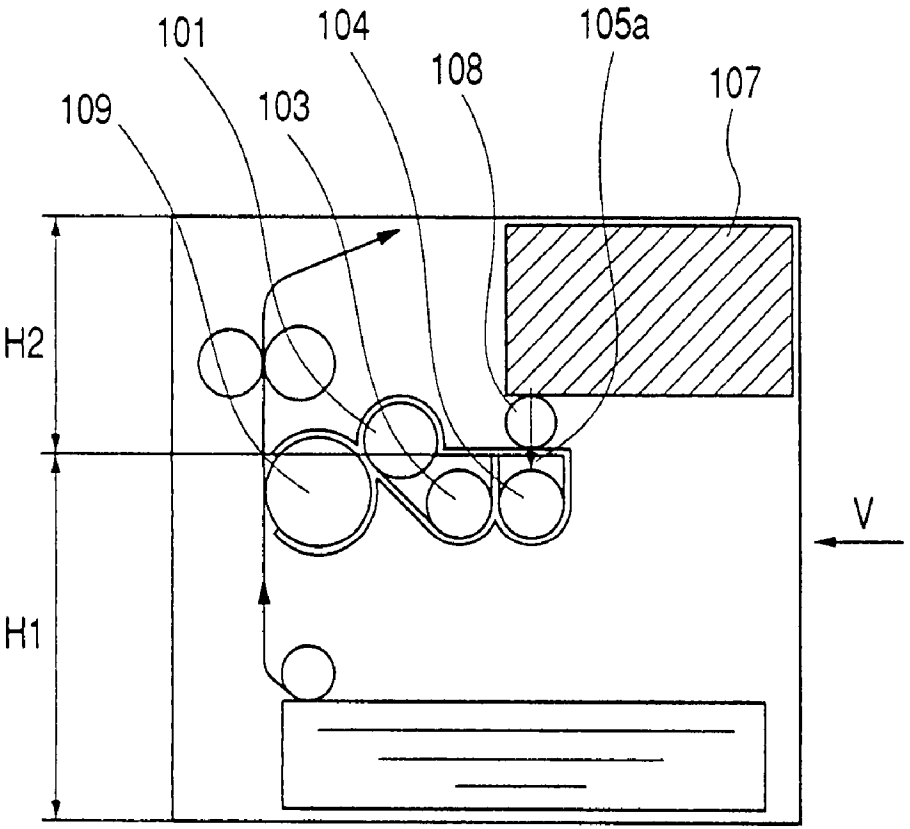
FIG. 9A PRIOR ART
FIG. 9A is a schematic cross-sectional view of a conventional image forming apparatus.

FIGS. 3A, 3B, 3C, 4A, 4B and 4C are views for comparing an image forming apparatus using the conventional developing apparatus and an image forming apparatus using the developing apparatus of the present invention with each other, FIGS. 3A and 4A, like FIG. 9A, being schematic side views of the image forming apparatus using the conventional developing apparatus, FIGS. 3B and 4B being schematic cross-sectional views of the image forming apparatus using the developing apparatus of the present invention, and FIGS. 3C and 4C being schematic rear views as viewed along the direction indicated by the arrow V in FIGS. 3B and 4B.

If by adopting the dimension D by which the supply port is made lower as previously described, the height of the entire image forming apparatus and the position of the developing apparatus in the image forming apparatus are constant, the space in the image forming apparatus the toner storing container (toner supplying container) 7 can occupy becomes larger by an amount corresponding to the dimension D by which the position of the supply port 5*a* could be made lower and a toner storing container 7 of a large capacity can be realized. Therefore, it becomes possible to reduce a running cost.

Also, if as shown in FIGS. 4A, 4B and 4C, the capacity of the toner storing container 7 and the position of the developing apparatus are constant, the height of the entire image forming apparatus becomes smaller by an amount corresponding to the dimension by which the position of the supply port 5*a* could be made lower, and the downsizing of the image forming apparatus becomes possible. Also, in a case where in order to realize the downsizing of the image forming apparatus and the larger capacity of the toner storing container 7, a portion of a toner carrying path is compelled to effect the carrying of the toner from below to above which opposes gravity, the carrying from below to above which opposes gravity can be decreased by an amount corresponding to the dimension by which the position of the supply port 5*a* could be made lower, or can be eliminated, and it becomes possible to mitigate or eliminate such an inconvenience as the remaining or clogging of the toner.

As a result, it becomes possible to provide an image forming apparatus which can make the downsizing of the image forming apparatus and the larger capacity of the toner storing container 7 and the maintenance of reliability compatible.

Also, in the developing apparatus of the present invention, there is a difference in the height of the powder surface in the reversing portion (X in FIG. 2A) for the developer from the developing chamber 5*b* to the agitating chamber, and the powder surface is of a substantially equal height in the reversing portion (Y in FIG. 2A) for the developer from the agitating chamber 5*c* to the developing chamber 5*b*. As a result, as compared with the conventional developing apparatus in which the developer is circulated with the powder surface of the same height, there is the merit that in the reversing portion X, the developer is circulated from the higher side to the lower side of the powder surface and therefore the back flow of the developer can be made very small.

Further, the container of the developing apparatus of the present invention is such that the cylinder portions of the agitating chamber 5*c* and the developing chamber 5*b* are directionally twisted to each other. This also leads to the merit that as compared with the conventional developing apparatus in which the cylinder portions of the agitating chamber 5*c* and the developing chamber 5*b* are parallel to each other, the twist rigidity when the container is molded with a thin wall is improved.

As described above, according to the developing apparatus of the present invention, if the height of the entire image forming apparatus and the position of the developing apparatus in the image forming apparatus are made constant, the space in the image forming apparatus the toner storing container can occupy becomes larger by an amount corresponding to the dimension by which the position of the supply port could be made lower, and a toner storing container of a large capacity can be realized, and it becomes possible to reduce the running cost.

Also, if the capacity of the toner storing container and the position of the developing apparatus are made constant, the height of the entire image forming apparatus becomes smaller by an amount corresponding to the dimension by which the position of the supply port could be made lower, and the downsizing of the image forming apparatus becomes possible.

Further, by adopting a construction in which the toner supply to the agitating chamber is effected from above the agitating chamber, the length of the developing container can be made as short as possible, as compared with a construction in which the length of the agitating chamber is made greater than that of the developing chamber and the toner is supplied to that lengthened area.

Also, in a case where in order to realize the downsizing of the image forming apparatus and the larger capacity of the toner storing container, a portion of the toner carrying path is compelled to effect the carrying of the toner from below to above which opposes gravity, the carrying from below to above which opposes gravity can be decreased by an amount corresponding to the dimension by which the position of the supply port could be made lower, or can be eliminated, and it becomes possible to mitigate or eliminate such inconveniences as the remaining and clogging of the toner.

As a result, it becomes possible to provide an image forming apparatus of high quality which can make the downsizing of the image forming apparatus and a reduction in running cost by the larger capacity of the toner storing container and the maintenance of reliability compatible.

Second Embodiment

Figure 5:
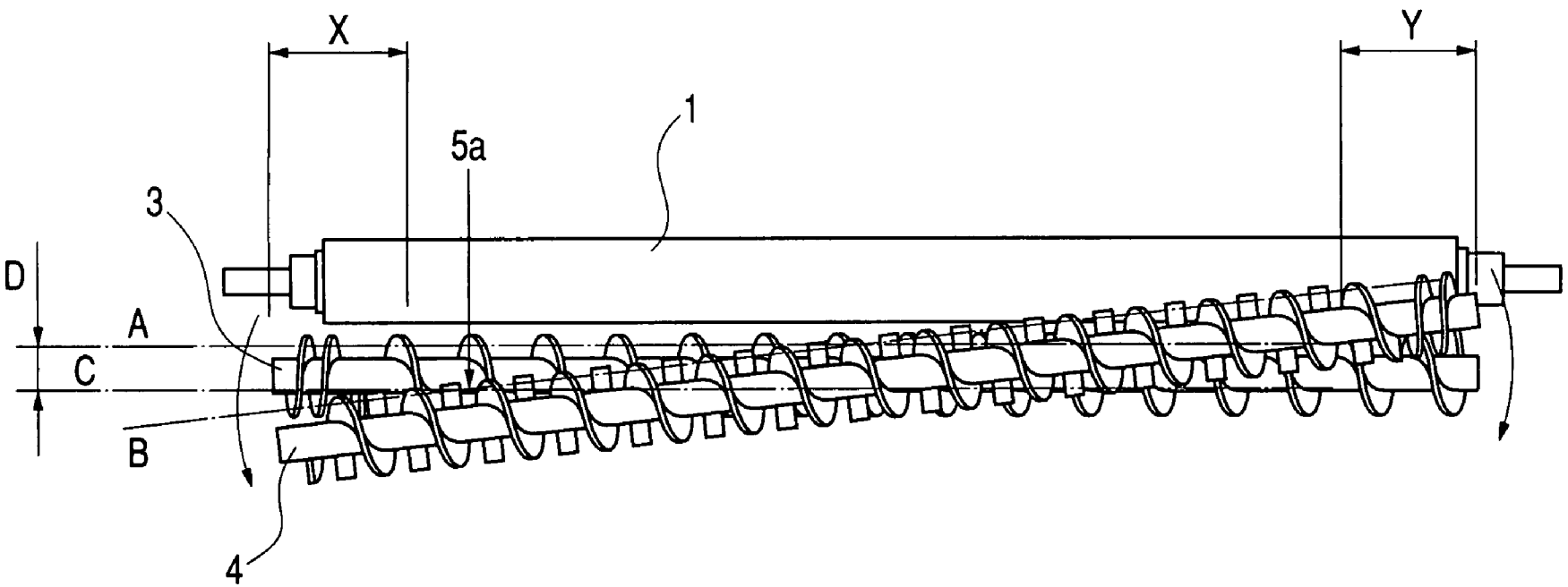
FIG. 5 is an illustration of a developing apparatus according to a second embodiment of the present invention.

FIG. 5 shows a developing apparatus according to a second embodiment of the present invention, and the difference of this embodiment from the first embodiment is that there is a difference in the height of the powder surface in the reversing portion (X in FIG. 5) for the developer from the developing chamber 5*b* to the agitating chamber 5*c* and further, there is also a difference in the height of the powder surface in the reversing portion (Y in FIG. 5) for the developer from the agitating chamber to the developing chamber. The other symbols are similar in significance to those in FIGS. 2A and 2B.

When there is adopted such a construction in which a difference in the height of the powder surface is provided in the reversing portions (X and Y in FIG. 5) at the opposite ends of the developing chamber screw 3 and the agitating chamber screw 4, the difference between the height of the powder surface in the developing chamber 5*b* and the height of the powder surface in the agitating chamber 5*c* becomes small as compared with that in the first embodiment, and the dimension D by which the supply port 5*a* can be made lower becomes somewhat smaller. However, in the both reversing portions, the developer is circulated from the higher side to the lower side of the powder surface, and this leads to the merit that the back flow of the developer in the communication paths between the developing chamber and the agitating chamber can be prevented.

Third Embodiment

Figure 6B:
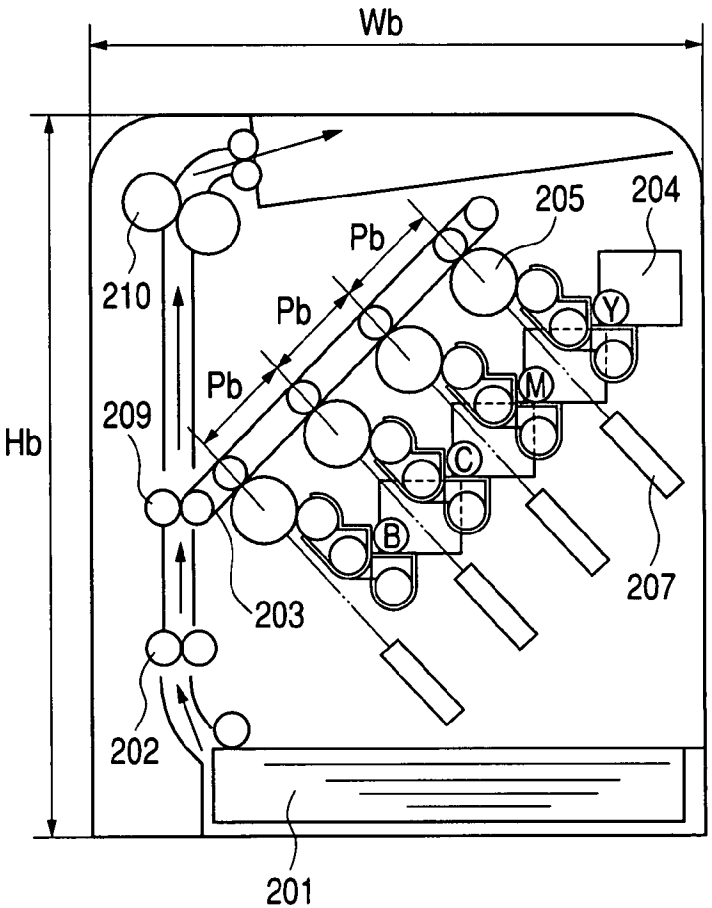
FIG. 6B shows an example in which the developing apparatus of the present invention is applied to a color image forming apparatus.
Figure 6A:
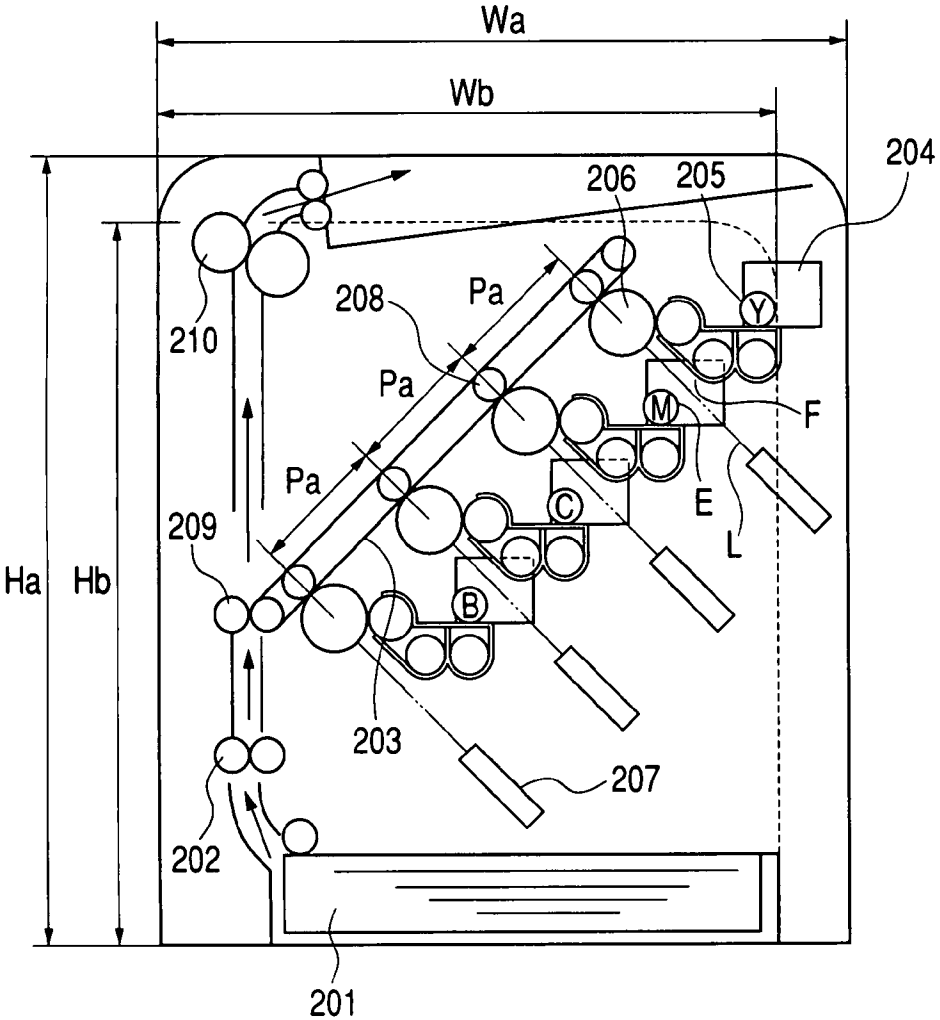
FIG. 6A shows an example in which a conventional developing apparatus is applied to a color image forming apparatus.
Figure 7:
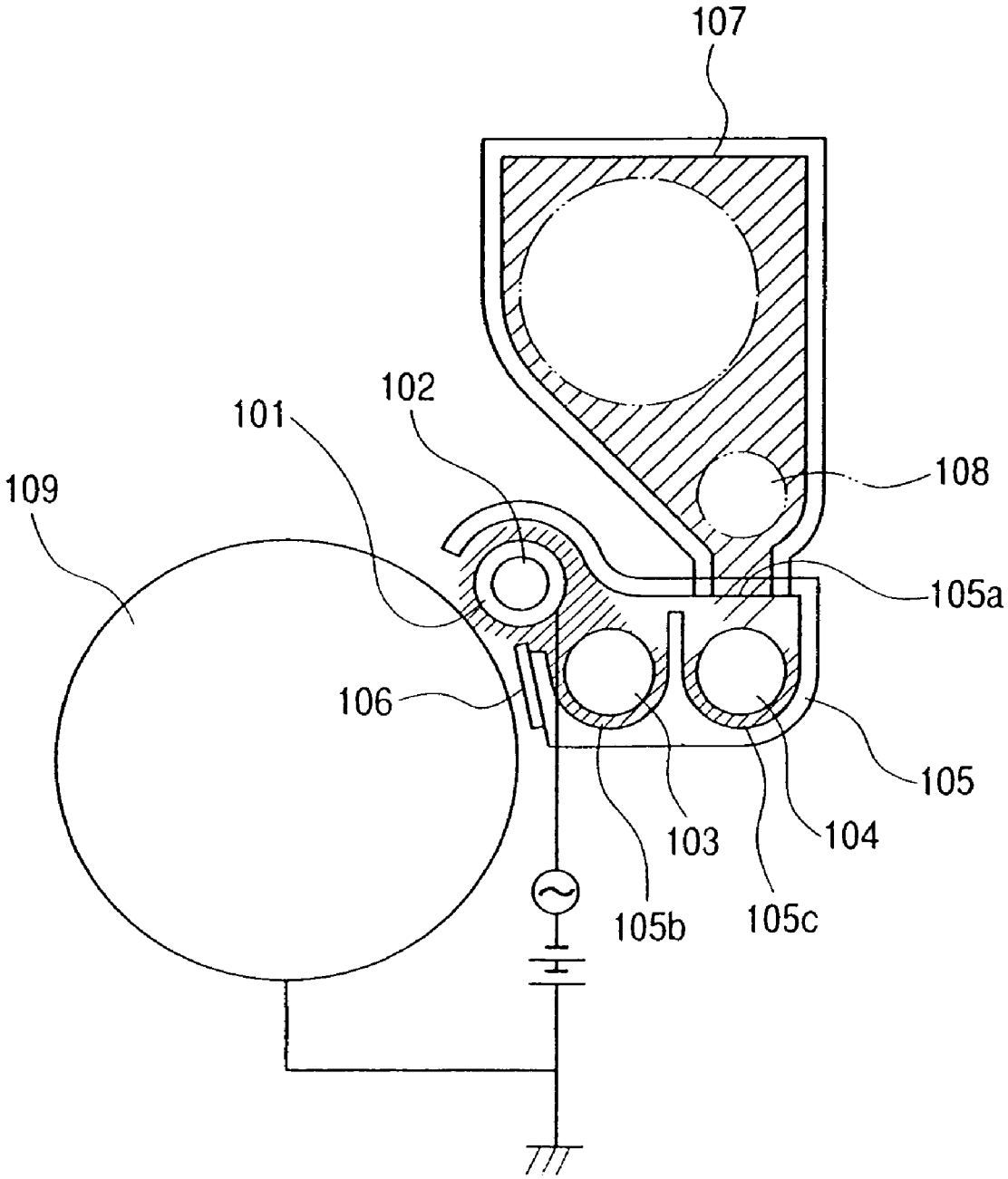
FIG. 7 PRIOR ART
FIG. 7 is a cross-sectional view of a conventional developing apparatus.
Figure 8:
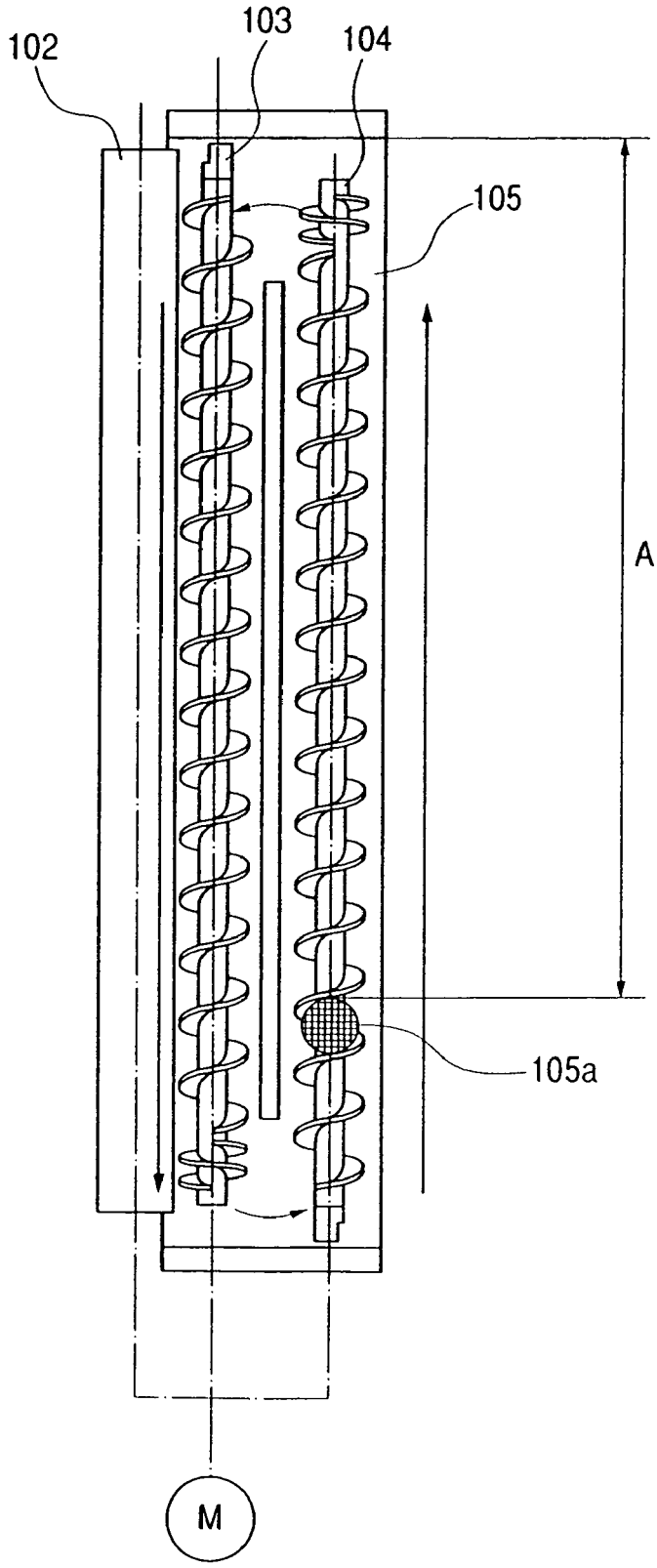
FIG. 8 PRIOR ART
FIG. 8 is a plan view of the conventional developing apparatus.

FIGS. 6A and 6B are schematic cross-sectional views of a full-color image forming apparatus of a toner replenishment type using an electrophotographic type indirect transferring process (a tandem type image forming apparatus provided with an image forming station for each color), FIG. 6A showing a case where the conventional developing apparatus is disposed therein, and FIG. 6B showing a case where the developing apparatus of the present invention is disposed therein. In FIGS. 6A and 6B, the reference numeral 201 designates feeding means for separating and feeding stacked recording materials, the reference numeral 202 denotes registration rollers for detecting the leading edge of the recording material and conveying the recording material in synchronism with an image signal, the reference numeral 203 designates a transferring belt on which an intermediate image is formed, the reference numeral 204 denotes toner storing containers filled with toners of four colors (Y, M, C and B indicate four colors, i.e., yellow, magenta, cyan and black), the reference numeral 205 designates supplying screws for carrying required amounts of developers from the toner storing containers, the reference numeral 206 denotes developing apparatuses including photosensitive drums, the reference numeral 207 designates exposure means for forming latent images on the photosensitive drums, the reference numeral 208 denotes transferring means for applying an opposite bias to thereby transfer toner images to the transferring belt, the reference numeral 209 designates transferring means for applying an opposite bias to thereby transfer the toner images from the transferring belt to the recording material, and the reference numeral 210 denotes a fixing device for heating and pressurizing the recording material to thereby fix the toners into a permanent image, and the developing apparatus 206 and the toner storing containers 204 are disposed so as not to overlap each other in a direction perpendicular to the plane of the drawing sheet. By adopting such a construction, in the full-color image forming apparatus using the indirect transferring process, latent images on the photosensitive drums are visualized by developing devices, and the toner images are primary-transferred to the transferring belt, and further the images are secondary-transferred onto the recording material by an opposite bias being applied thereto from the back of the recording material, thereby forming an image.

Here, a great factor which determines the height H (Ha: the conventional art, Hb: the present embodiment) of the developing apparatus and the width W (Wa: the conventional art, Wb: the present embodiment) of the developing apparatus is the interval P (Pa: the conventional art, Pb: the present embodiment) between adjacent ones of the developing apparatuses. This interval P is designed such that an optical axis L linking adjacent ones of the supplying screws 205, the developing apparatuses 206, the exposure means 207 and the photosensitive drums together does not interfere in a portion E or a portion F in FIG. 6A.

As shown in FIG. 6A, in the conventional developing apparatus, the developing chamber and the agitating chamber are at the same height and a supply port is provided above them and a supplying screw is disposed and therefore, both of the height and the width become great, but if the developing apparatus of the present invention is applied as shown in FIG. 6B, a supply port is provided at the same height as the developing chamber and a supplying screw is disposed and therefore, a construction in which both of the height and the width are small becomes possible. That is, according to such a construction, the optical path from each exposure means is secured and yet the downsizing of a so-called tandem type image forming apparatus can be achieved.

Thus, the developing apparatus of the present invention, when a plurality of developing apparatuses are juxtaposed in an image forming apparatus, can make the effect for the downsizing of the image forming apparatus greater, in addition to the effects of the first embodiment and the second embodiment.

Other Embodiments

While in the aforedescribed embodiments, a printer has been shown and described as the image forming apparatus, this is not restrictive, but the present invention can also be applied to a facsimile apparatus, a copying machine, etc.

As described above, according to each of the above-described embodiments, it is possible to achieve the larger capacity of the toner storing container for supplying the developer to the developer supply port and yet achieve the downsizing of the image forming apparatus. Accordingly, it is possible to make the downsizing of the image forming apparatus and the larger capacity of the developing container and the maintenance of reliability compatible.

What is claimed is:

1. A developing apparatus for developing an electrostatic image formed on an image bearing member, said developing apparatus comprising:

a developing container containing therein a developer including a toner and a carrier said developing container including a first chamber having a developer carrying member for carrying the developer, a second chamber to which the toner is supplied, a first communicating portion for supplying the developer from one end side in a longitudinal direction of said first chamber to one end side in a longitudinal direction of said second chamber, and a second communicating portion for supplying the developer from the other end side in the longitudinal direction of said second chamber to the other end side in the longitudinal direction of said first chamber, said second chamber being disposed in an inclined manner so that the one end side of said second chamber is disposed in a position lower than the other end side of said second chamber, and a ceiling portion of the one end side of said second chamber being disposed in a position lower than a ceiling portion of the one end side of said first chamber;

circulating means for circulating the developer between said first chamber and said second chamber; and a developer supplying screw for supplying the toner to said second chamber through a supply port provided in a bottom of a developer supplying path, wherein said supply port of said developer supplying path is disposed in a position lower than the ceiling portion of the one end side of said first chamber, and wherein said supply port is located at an upper portion on a downstream side of said first communicating portion in a developer conveying direction on the one end side of said second chamber.

2. A developing apparatus according to claim 1, wherein the developer conveying direction in said developer supplying path is substantially parallel with and opposite to a developer conveying direction in said first chamber.

3. A developing apparatus according to claim 1, wherein a ceiling portion of the other end side of said second chamber is substantially at a same height as a ceiling portion of the other end side of said first chamber.

4. A developing apparatus according to claim 1, wherein a ceiling portion of the other end side of said second chamber is located above a ceiling portion of the other end side of said first chamber.

5. A developing apparatus for developing an electrostatic image formed on an image bearing member, said developing apparatus comprising:

a developing container containing therein a developer including a toner and a carrier, said developing container including a first chamber having a developer carrying member for carrying the developer, a second chamber to which the toner is supplied, a first communicating portion for supplying the developer from one end side in a longitudinal direction of said first chamber to one end side in a longitudinal direction of said second chamber, and a second communicating portion for supplying the developer from the other end side in the longitudinal direction of said second chamber to the other end side in the longitudinal direction of said first chamber, said second chamber being disposed in an inclined manner so that the one end side of said second chamber is disposed in a position lower than the other end side of said second chamber, and a ceiling portion of the one end side of said second chamber being disposed in a position lower than a ceiling portion of the one end side of said first chamber;

circulating means for circulating the developer in a developer circulating path formed by said first chamber, said first communicating portion, said second chamber, and said second communicating portion; and a developer supplying screw for supplying the toner to said second chamber through a supply port provided in a bottom of a developer supplying path, wherein said supply port of said developer supplying path is disposed in a position lower than the ceiling portion of the one end side of said first chamber, and wherein said supply port is located at an upper portion of the one end side of said second chamber in said developer circulating path.

* * * * *

UNITED STATES PATENT AND TRADEMARK OFFICE

CERTIFICATE OF CORRECTION

PATENT NO. : 7,046,945 B2
APPLICATION NO. : 10/682870
DATED : May 16, 2006
INVENTOR(S) : Hitoshi Nishitani et al.

It is certified that error appears in the above-identified patent and that said Letters Patent is hereby corrected as shown below:

COLUMN 1:
Line 18, “to between” should read --to the space between--.
Line 35, “to between” should read --to the space between--.

COLUMN 2:
Line 51, “motor” should read --motor,--.

COLUMN 3:
Line 63, “as the” should read --of the--.
Line 64, “that in” should read --in that--.
Line 67, “at a time.” should read --at the same time.--.

COLUMN 4:
Line 7, “both of the” should read --both the--.

COLUMN 6:
Line 6, “supplied” should read --being supplied--.
Line 54, “both of the” should read --both the--.

COLUMN 9:
Line 32, “in the both” should read --in both--.

COLUMN 10:
Line 34, “both of the” should read --both the--.
Line 39, “both of the” should read --both the--.

UNITED STATES PATENT AND TRADEMARK OFFICE

CERTIFICATE OF CORRECTION

PATENT NO. : 7,046,945 B2
APPLICATION NO. : 10/682870
DATED : May 16, 2006
INVENTOR(S) : Hitoshi Nishitani et al.

It is certified that error appears in the above-identified patent and that said Letters Patent is hereby corrected as shown below:

COLUMN 11:
Line 6, "carrier" should read --carrier,--.

Signed and Sealed this

Fifteenth Day of May, 2007

JON W. DUDAS
*Director of the United States Patent and Trademark Office*